US005205249A

United States Patent [19]

Markley et al.

[11] Patent Number: 5,205,249

[45] Date of Patent: Apr. 27, 1993

[54] VARIABLE CAMSHAFT TIMING SYSTEM FOR INTERNAL COMBUSTION ENGINE UTILIZING FLYWHEEL ENERGY FOR REDUCED CAMSHAFT TORSIONALS

[75] Inventors: George L. Markley, Montour Falls; Roger P. Butterfield, Interlaken, both of N.Y.

[73] Assignee: Borg-Warner Automotive Transmission & Engine Components Corporation, Sterling Heights, Mich.

[21] Appl. No.: 883,581

[22] Filed: May 14, 1992

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2, 160

[56] References Cited

U.S. PATENT DOCUMENTS

| | | | |
|---|---|---|---|
| 5,002,023 | 3/1991 | Butterfield | 123/90.15 |
| 5,046,460 | 9/1991 | Butterfield et al. | 123/90.15 |
| 5,056,477 | 10/1991 | Linder et al. | 123/90.17 |
| 5,056,478 | 10/1991 | Ma | 123/90.17 |
| 5,078,647 | 1/1992 | Hampton | 123/90.17 |
| 5,107,804 | 4/1992 | Becker et al. | 123/90.17 |
| 5,121,717 | 6/1992 | Simko et al. | 123/90.17 |

*Primary Examiner*—E. Rollins Cross
*Assistant Examiner*—Weilun Lo
*Attorney, Agent, or Firm*—Willian Brinks Olds et al.

[57] ABSTRACT

A camshaft (126) has a vane (160) secured to an end thereof for non-oscillating rotation therewith. The vane has opposed lobes (160a/160b) which are received in opposed recesses (132a/132b) respectively, of a sprocket (132) which is oscillatingly journalled on the camshaft. The recesses have greater circumferential extent than the lobes to permit the vane and sprocket to oscillate with respect to one another, and thereby permit the camshaft to change in phase relative to a crankshaft whose phase relative to the sprocket is fixed by virtue of a timing belt drive extending therebetween. The camshaft experiences torque reversals as it rotates due to valve follower force on cam lobes attached to the camshaft, and such torque reversals are partly counteracted by a flywheel (144) fixedly attached to the camshaft. The camshaft phase is permitted to change in a given direction, either to advance or retard, by selectively blocking or permitting the flow of hydraulic fluid, preferably engine oil, from the recesses by controlling the position of a spool (200) within a valve body (192) of a control valve in response to a signal indicative of an engine operating condition from an engine control unit (208).

25 Claims, 11 Drawing Sheets

VARIABLE CAMSHAFT TIMING SYSTEM FOR INTERNAL COMBUSTION ENGINE UTILIZING FLYWHEEL ENERGY FOR REDUCED CAMSHAFT TORSIONALS

FIELD OF THE INVENTION

This invention relates to an internal combustion engine in which the timing of the camshaft of a single camshaft engine, or the timing of one or both of the camshafts of a dual camshaft engine, relative to the crankshaft is varied to improve one or more of the operating characteristics of the engine.

BACKGROUND OF THE INVENTION

It is known that the performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. It is also known that engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of its intake valves relative to its exhaust valves or in terms of the operation of its valves relative to the position of the crankshaft. It is also known that the performance of an internal combustion engine having but a single camshaft can be improved by changing the positional relationship of the camshaft relative to the crankshaft.

A method for making such changes in engine valve timing has been achieved by a separate hydraulic motor operated by engine lubricating oil. However, this actuating arrangement consumes significant additional energy and it increases the required size of the engine lubricating pump because of the required rapid response time for proper operation of the camshaft phasing actuator. Further, these arrangements are typically limited to a total of 20° of phase adjustment between crankshaft position and camshaft position, and typically such arrangements are two-position arrangements, that is, on, or fully phase adjusted as one position, or off, or no phase adjustment, as a second position. The present invention is designed to overcome these problems associated with prior art variable camshaft timing arrangements by providing a variable camshaft timing arrangement, which does not add significantly to the required size of the engine lubricating pump to meet transient hydraulic operation requirements of such variable camshaft timing arrangement, which provides for continuously variable camshaft to crankshaft phase relationship within its operating limits, and which provides substantially more than 20° of phase adjustment between the crankshaft position and the camshaft position.

SUMMARY OF THE INVENTION

The present invention provides a phase adjustment arrangement for an internal combustion engine in which the position of the camshaft, or the positions of one or both of the camshafts in a dual camshaft system, is phase adjusted relative to the crankshaft, that is, in which the camshaft is advanced or retarded relative to the crankshaft by an actuating arrangement which is controlled, for example, by a microprocessor, to control one or more important engine operating characteristics, such as idle quality, fuel economy, emissions, or torque.

In a first embodiment the actuating arrangement uses one or more radially extending vanes which are circumferentially fixed relative to the camshaft and which are received in cavities of a sprocket housing that is oscillatable on the camshaft. Hydraulic fluid, in the form of engine oil, is selectively pumped to one side or another of each vane to advance or retard the position of the sprocket relative to the camshaft in reaction to changes in torque loads which are experienced by a camshaft as each of its lobes changes its angle of contact with the cam follower of the valve lifter of the engine which is operated thereby. Such flow into and out of the opposed vanes is either blocked or permitted in one direction by a control valve, and the operation of the control valve is controlled by the engine control microprocessor, to ensure that the advancing or retarding of the position variable camshaft only occurs when desired. Flywheel energy is utilized, for example by attaching a disc to the camshaft, to reduce camshaft torsional effects. With the reduction in torsionals, hydraulic fluid is more efficiently pumped to the opposed vanes. Thus, suitable VCT phase actuation rates can be accomplished without an appreciable loss of lube oil pressure and without use of a larger engine oil lubricating pump than would otherwise be required.

In an alternative embodiment, the actuating arrangement utilizes a pair of oppositely acting hydraulic cylinders to advance or retard the angular position of a camshaft relative to the crankshaft as was disclosed in U.S. Pat. No. 5,002,023, the disclosure of which is incorporated by reference herein.

Accordingly, it is an object of the present invention to provide an improved variable camshaft timing arrangement for an internal combustion engine. More particularly, it is an object of the present invention to provide a variable camshaft timing arrangement which utilizes flywheel energy to reduce camshaft torsional pulses to a workable level such that engine oil pressure can actuate the camshaft timing arrangement without significantly adding to the peak load pumping requirements of the engine lubricating pump. It is also an object of the present invention to provide a variable camshaft timing arrangement in which the position of a camshaft is continuously variable relative to the position of the crankshaft within its operating limits.

For a further understanding of the present invention and the objects thereof, attention is directed to the drawings and the following brief description thereof, to the detailed description of the preferred embodiment, and to the appended claims.

DETAILED DESCRIPTION OF THE PREFERRED EMBODIMENT

FIGS. 1–7 illustrate an embodiment of the present invention in which a housing in the form of a sprocket 132 is oscillatingly journalled on a camshaft 126. The camshaft 126 may be considered to be the only camshaft of a single camshaft engine, either of the overhead camshaft type or the in block camshaft type. Alternatively, the camshaft 126 may be considered to be either the intake valve operating camshaft or the exhaust valve operating camshaft of a dual camshaft engine. In any case, the sprocket 132 and the camshaft 126 are rotatable together, and are caused to rotate by the application of torque to the sprocket 132 by an endless roller chain 138, shown fragmentarily, which is trained around the sprocket 132 and also around a crankshaft, not shown. As will be hereinafter described in greater detail, the sprocket 132 is oscillatingly journalled on the camshaft 126 so that it is oscillatable at least through a limited arc with respect to the camshaft 126 during the rotation of the camshaft, an action which will adjust the phase of the camshaft 126 relative to the crankshaft.

Figure 1:
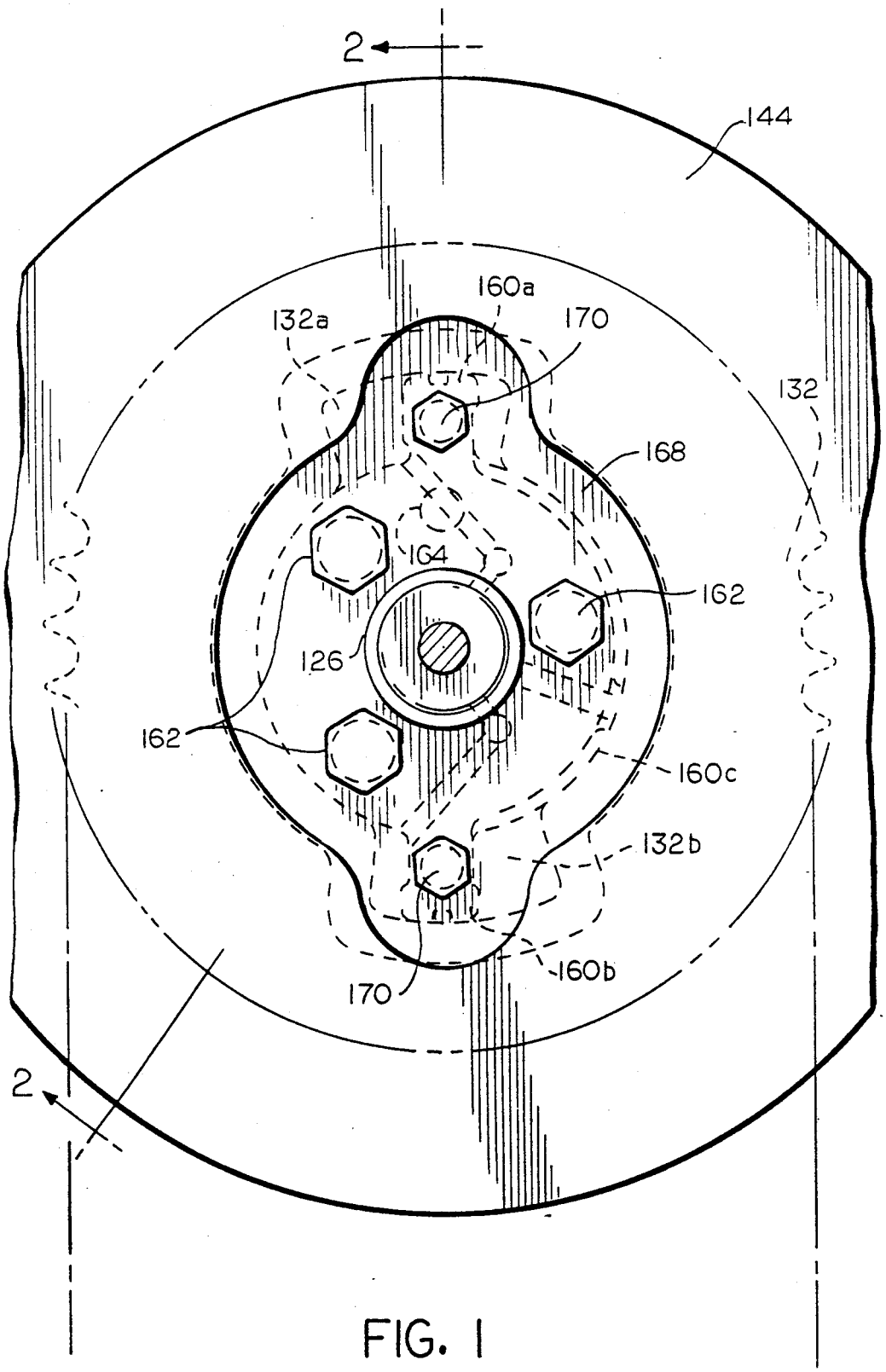
FIG. 1 is a fragmentary end elevational view of a camshaft with an embodiment of a variable camshaft timing system applied thereto.
Figure 2:
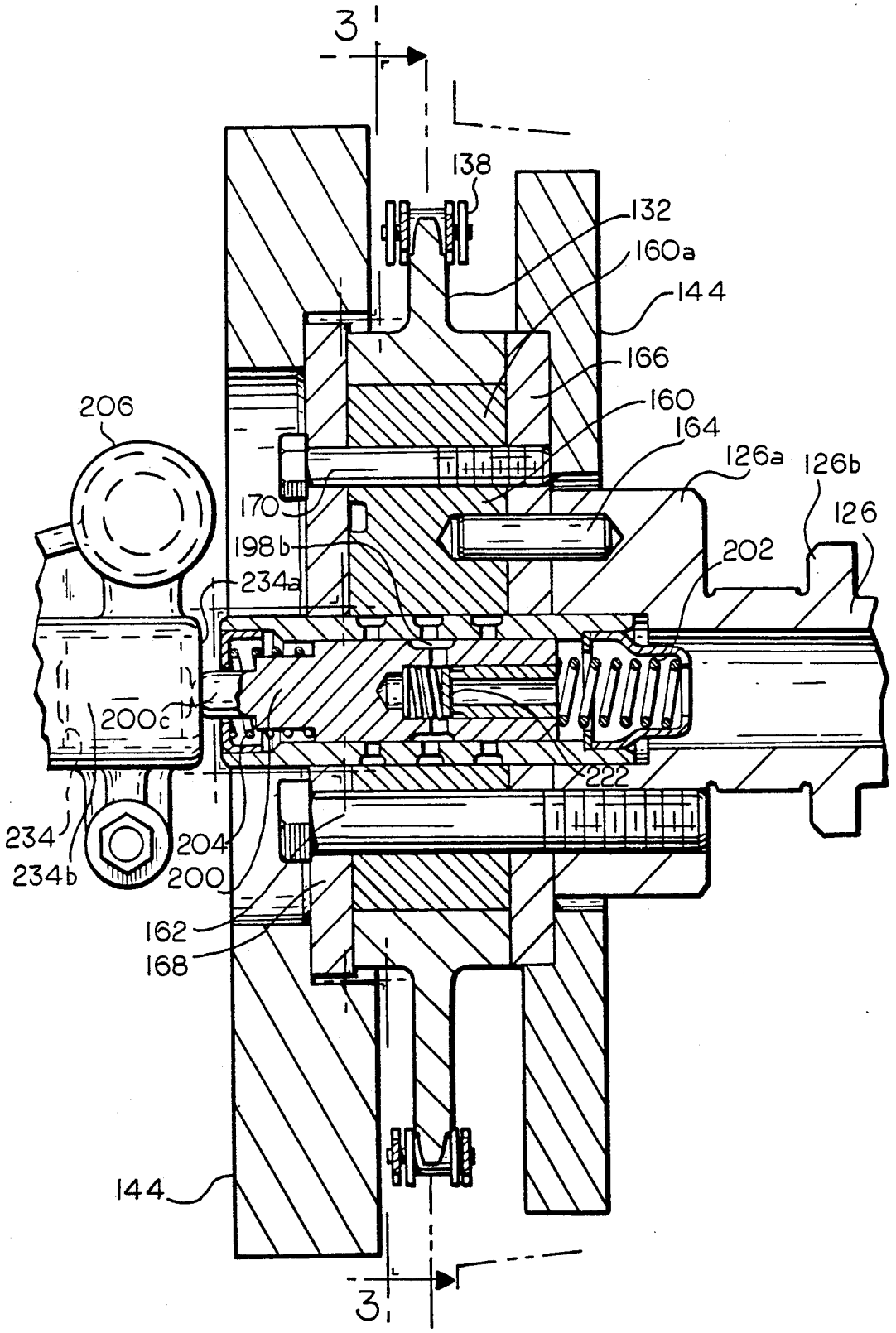
FIG. 2 is a sectional view taken on line 2—2 of FIG. 1.
Figure 3:
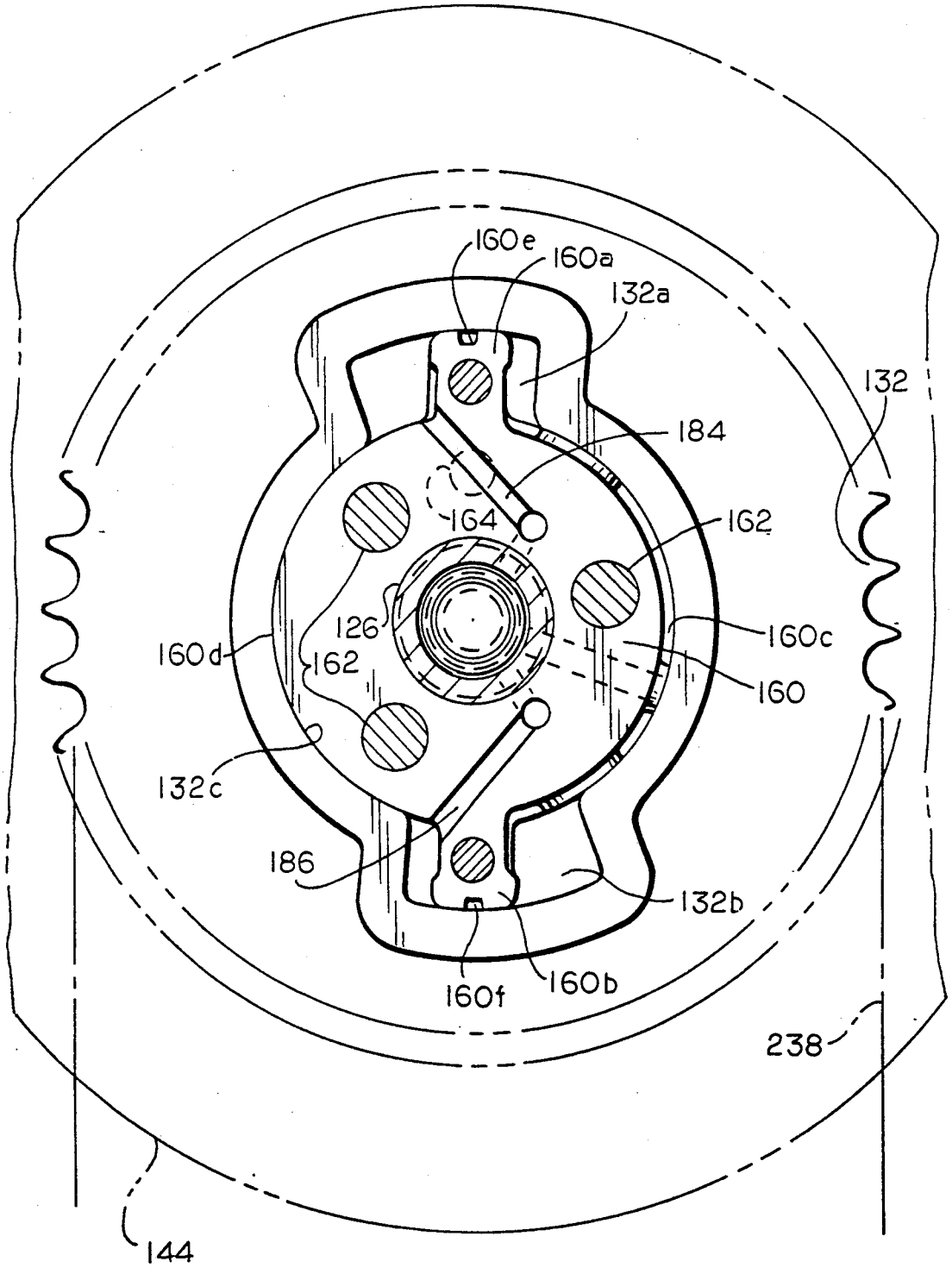
FIG. 3 is a sectional view taken on line 3—3 of FIG. 2 and is similar to FIG. 1 with a portion of the structure thereof removed to more clearly illustrate other portions thereof.
Figure 4:
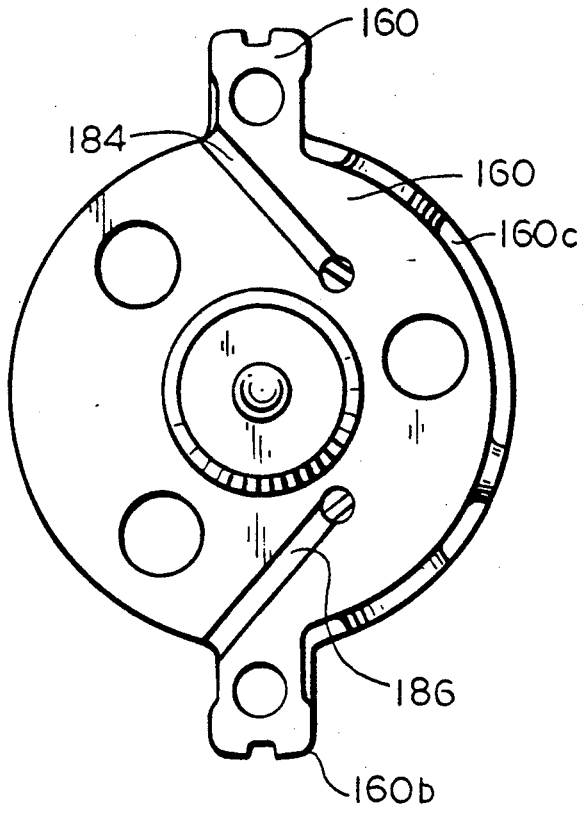
FIG. 4 is an end elevational view of an element of the variable camshaft timing system of FIGS. 1–3.
Figure 5:
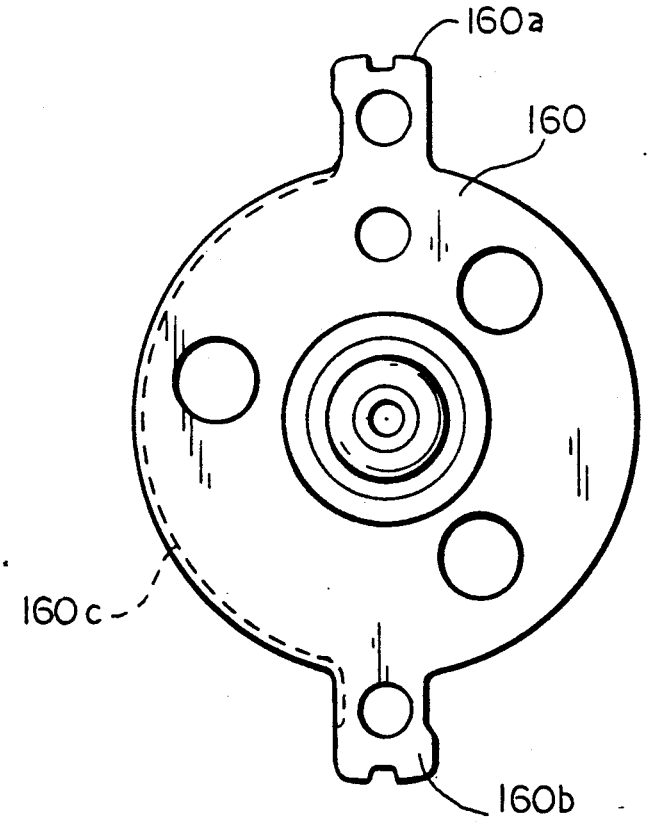
FIG. 5 is an elevational view of the element of FIG. 4 from the opposite end thereof.
Figure 6:
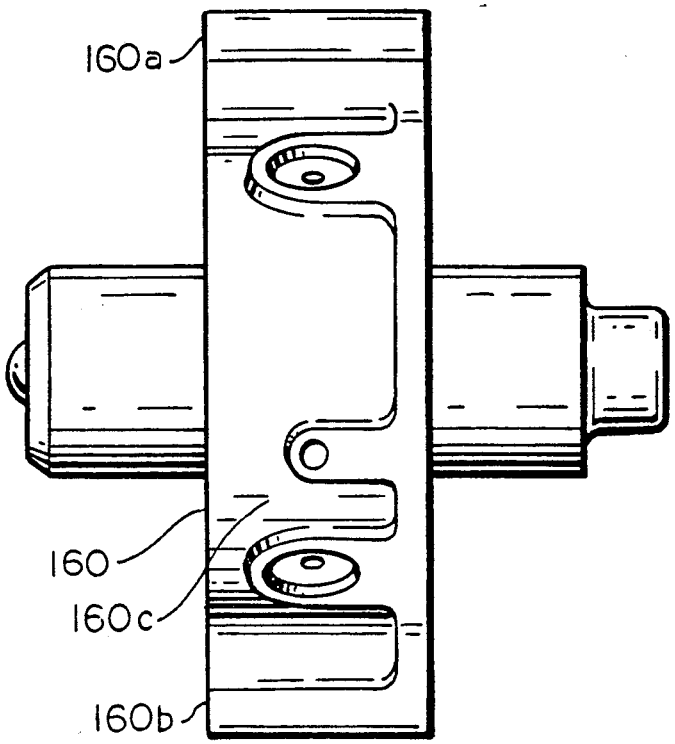
FIG. 6 is a side elevational view of the element of FIGS. 4 and 5.
Figure 7:
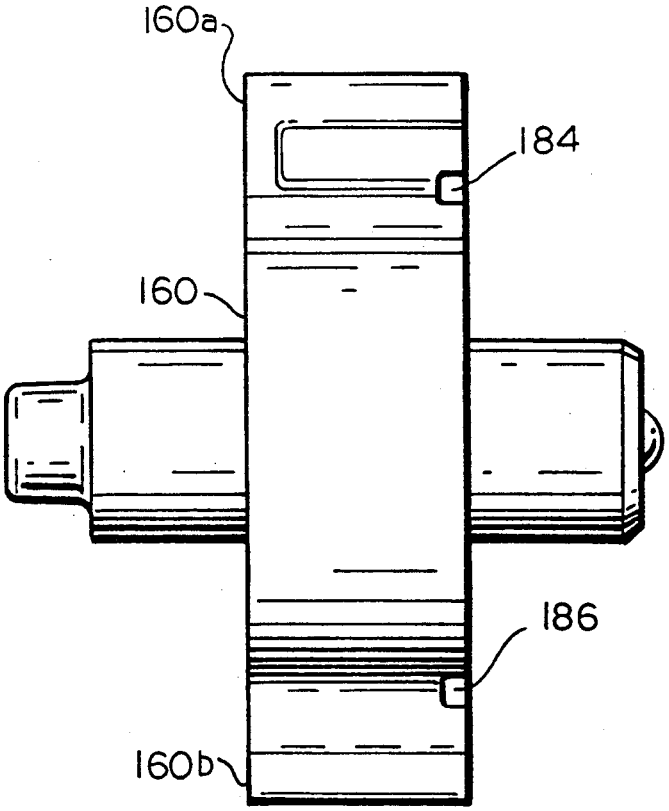
FIG. 7 is an elevational view of the element of FIG. 6 from the opposite side thereof.

A flywheel 144 in the form of a disc with a circular portion removed from its center is fixedly attached to the camshaft 126 as shown in FIGS. 1–3. Alternatively, the end portion **126*a* of the camshaft 126 can be increased in size to effectively act as a flywheel When the camshaft 126 rotates, it experiences torsional pulses as a result of valve follower forces on the cam lobes attached to the camshaft. These torsional pulses, which cause pressure surges in the hydraulic fluid lines, are counteracted by the flywheel 144 as it rotates with the camshaft 126 thus making checkvalves to trap such surges unnecessary. As a result, the engine oil pump, not shown, does not need to overcome these pulsations and its size need not be enlarged to accomodate the VCT system. The flywheel 144, which can be in a form other than the disc of FIGS. 1–3, can be attached at any available location along the camshaft and is not limited to the location as shown in FIGS. 1–3**. Additionally, a larger diameter camshaft can be used to counteract the torsional pulses.

An annular pumping vane 160 is fixedly positioned on the camshaft 126, the vane 160 having a diametrically opposed pair of radially outwardly projecting lobes **160*a*, 160*b* and being attached to an enlarged end portion 126*a* of the camshaft 126 by bolts 162 which pass through the vane 160 into the end portion 126*a*. In that regard, the camshaft 126 is also provided with a thrust shoulder 126*b* to permit the camshaft to be accurately positioned relative to an associated engine block, not shown. The pumping vane 160 is also precisely positioned relative to the end portion 126*a* by a dowel pin 164 which extends therebetween. The lobes 160*a*, 160*b* are received in radially outwardly projecting recesses 132*a*, 132*b*, respectively, of the sprocket 132, the circumferential extent of each of the recesses 132*a*, 132*b* being somewhat greater than the circumferential extent of the vane lobe 160*a*, 160*b* which is received in such recess to permit limited oscillating movement of the sprocket 132 relative to the vane 160. The recesses 132*a*, 132*b* are closed around the lobes 160*a*, 160*b*, respectively, by spaced apart, transversely extending annular plates 166, 168 which are fixed relative to the vane 160, and, thus, relative to the camshaft 126, by bolts 170 which extend from one to the other through the same lobe, 160*a*, 160*b*. Further the inside diameter 132*c* of the sprocket 132 is sealed with respect to the outside diameter of the portion 160*d* of the vane 160 which is between the lobes 160*a*, 160*b*, and the tips of the lobes 160*a*, 160*b* of the vane 160 are provided with seal receiving slots 160*e*, 160*f*, respectively. Thus each of the recesses 132*a*, 132*b* of the sprocket 132 is capable of sustaining hydraulic pressure, and within each recess 132*a*, 132*b*, the portion on each side of the lobe 160*a*, 160*b***, respectively, is capable of sustaining hydraulic pressure.

Figure 8:
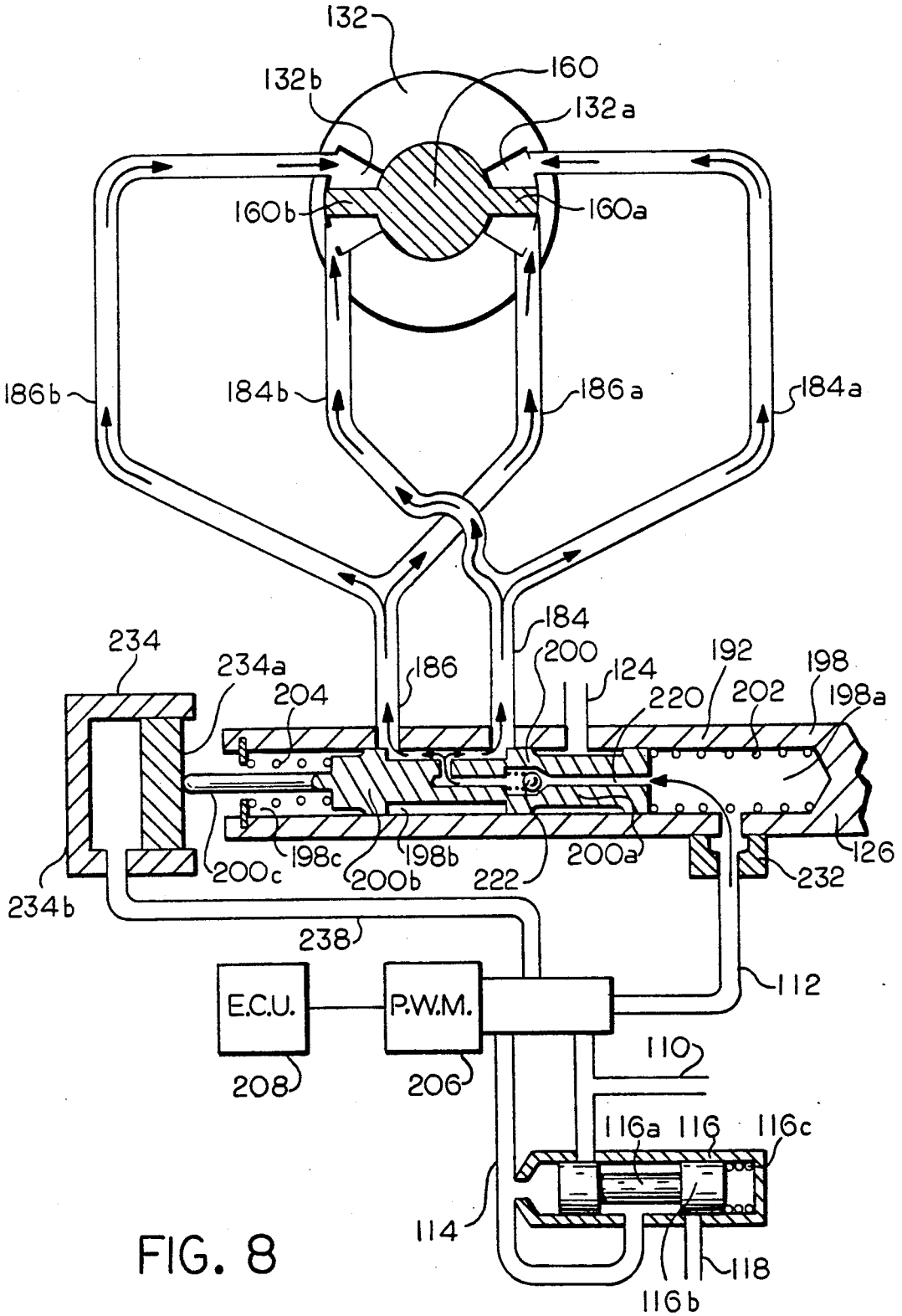
FIG. 8 is a schematic view of the hydraulic equipment of the variable camshaft timing arrangement according to the preferred embodiment and illustrates a condition where the camshaft phase is being maintained in a neutral position of the arrangement which is illustrated in FIG. 1.
Figure 9:
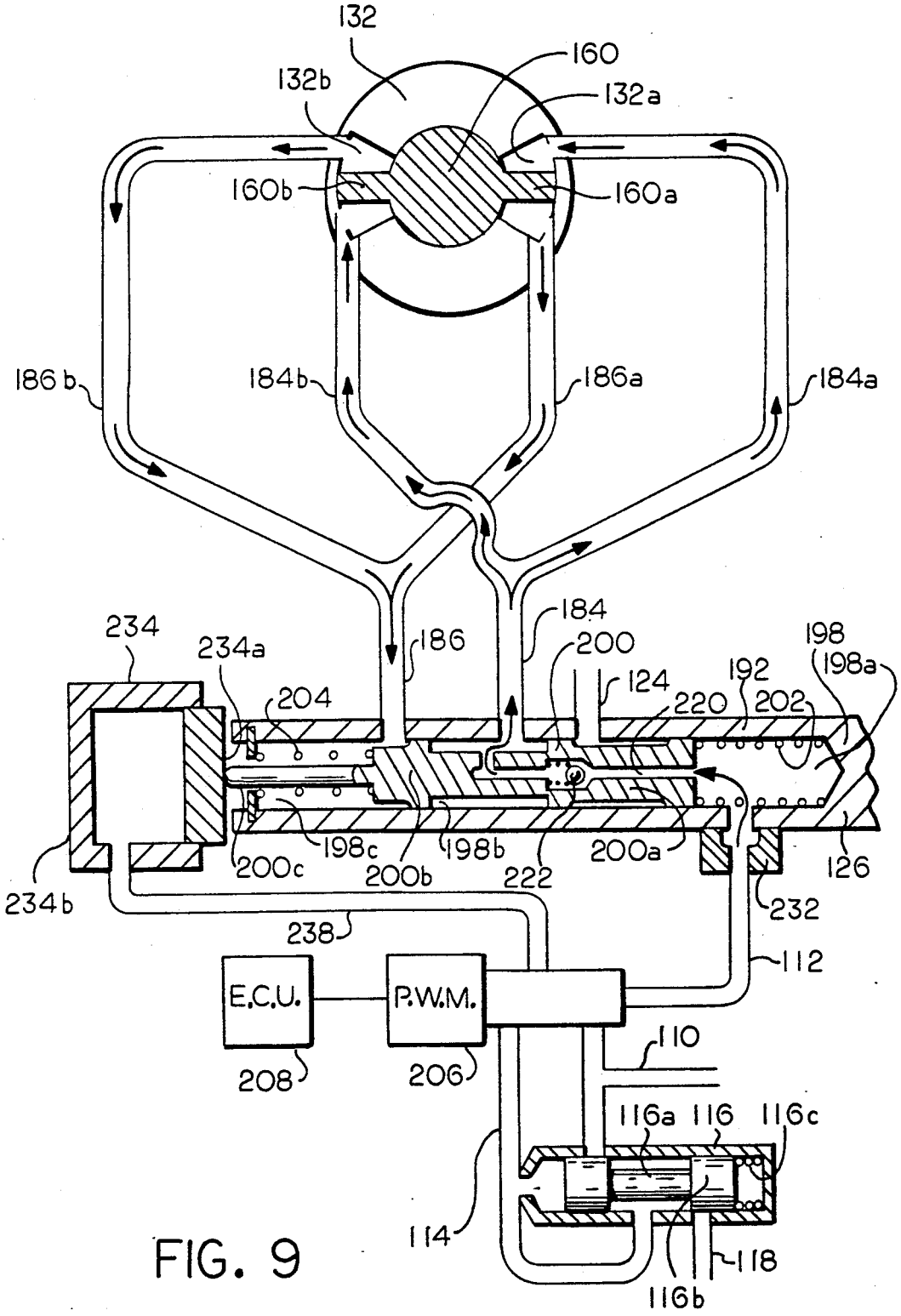
FIG. 9 is a schematic view of the hydraulic equipment of the variable camshaft timing arrangement according to the preferred embodiment and illustrates a condition where the camshaft phase is shifting in the direction of the advanced position of the arrangement which is illustrated in FIG. 1.
Figure 10:
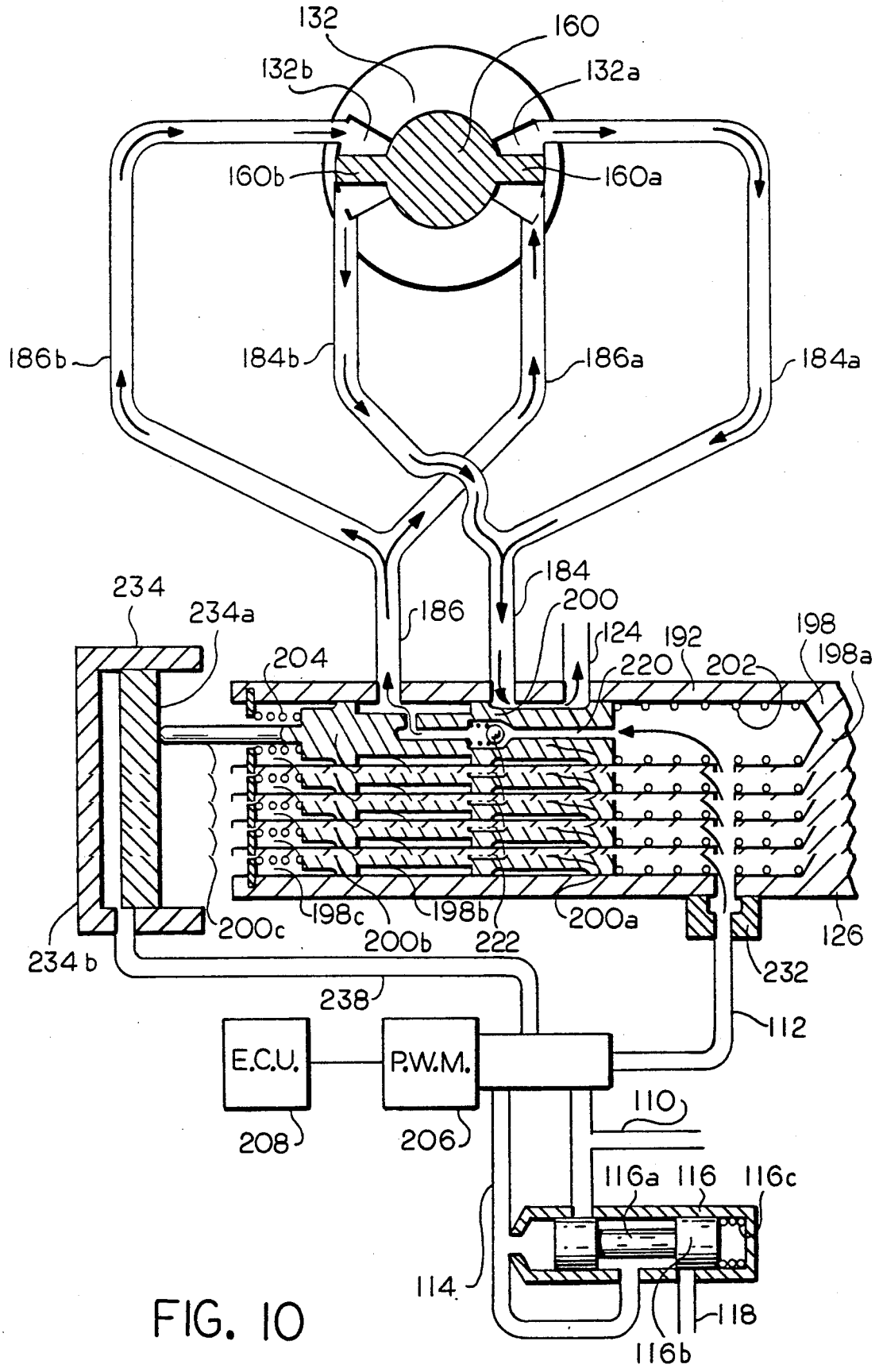
FIG. 10 is a schematic view of the hydraulic equipment of the variable camshaft timing arrangement according to the preferred embodiment and illustrates a condition where the camshaft phase is shifting in the direction of the retarded position of the arrangement which is illustrated in FIG. 1.

The functioning of the structure of the embodiment of FIGS. 1–7, as thus far described, may be understood by reference to FIGS. 8–10. Hydraulic fluid, illustratively in the form of engine lubricating oil, flows into the recesses **132*a*, 132*b* by way of passage lines 184, 186, which receive it from space 198*b*, line 112, and line 110 which leads to the main oil gallery (not shown). The passage lines 184, 186 each split into two branches, 184*a* and 184*b*, 186*a* and 186*b*, respectively, with one branch of each passage line terminating on opposite sides of recesses 132*a*, 132*b* such that when pressurized oil flows into one passage line or the other, the lobes 160*a*** and 160*b* are pushed in one direction or the other causing the vane assembly 160, and thus the camshaft 126, to shift phase with respect to the crankshaft. Hydraulic fluid enters the passage lines 184, 186 by way of a spool valve 192, which is incorporated within the camshaft 126, and hydraulic fluid is vented from the recesses 132*a*, 132*b* through passage lines 184, 186 respectively.

Figure 11:
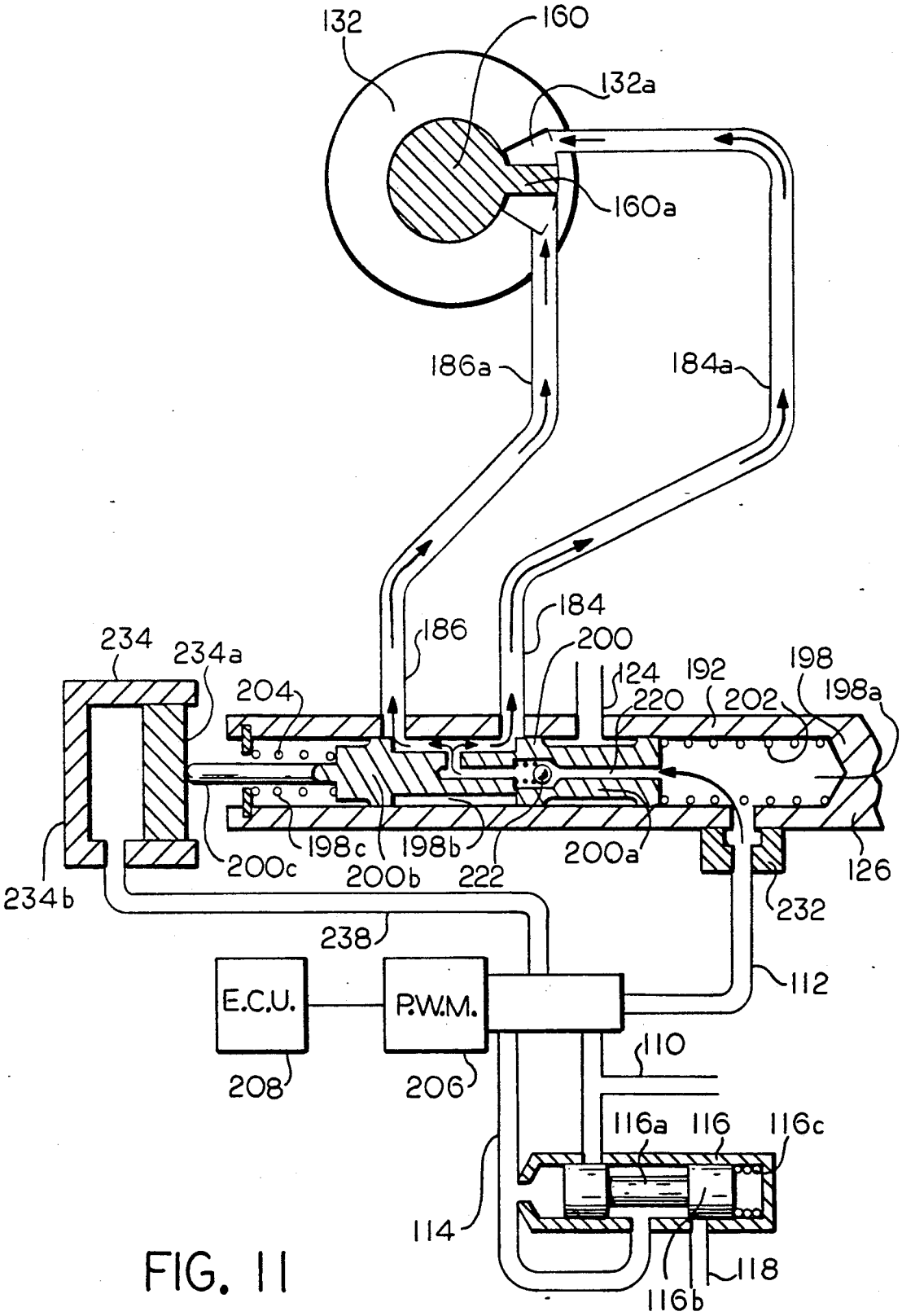
FIG. 11 is a schematic view of the hydraulic equipment of the variable camshaft timing arrangement according to an embodiment utilizing only one vane lobe to accomplish camshaft shift and illustrates a condition where the camshaft phase is being maintained in a neutral position.
Figure 12:
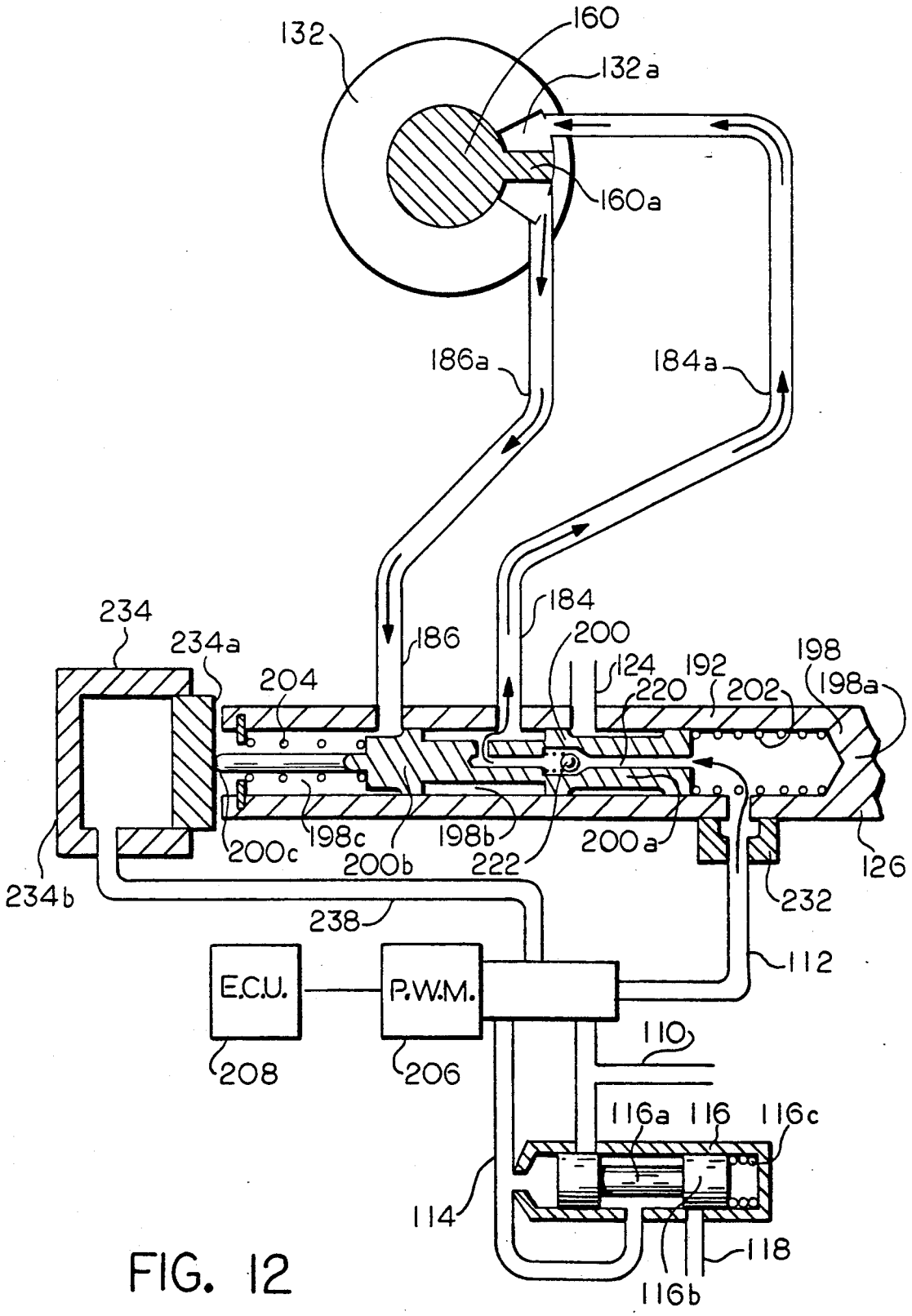
FIG. 12 is a schematic view of the hydraulic equipment of the variable camshaft timing arrangement according to an embodiment utilizing only one vane lobe to accomplish camshaft shift and illustrates a condition where the camshaft phase is shifting in the direction of the advanced position.
Figure 13:
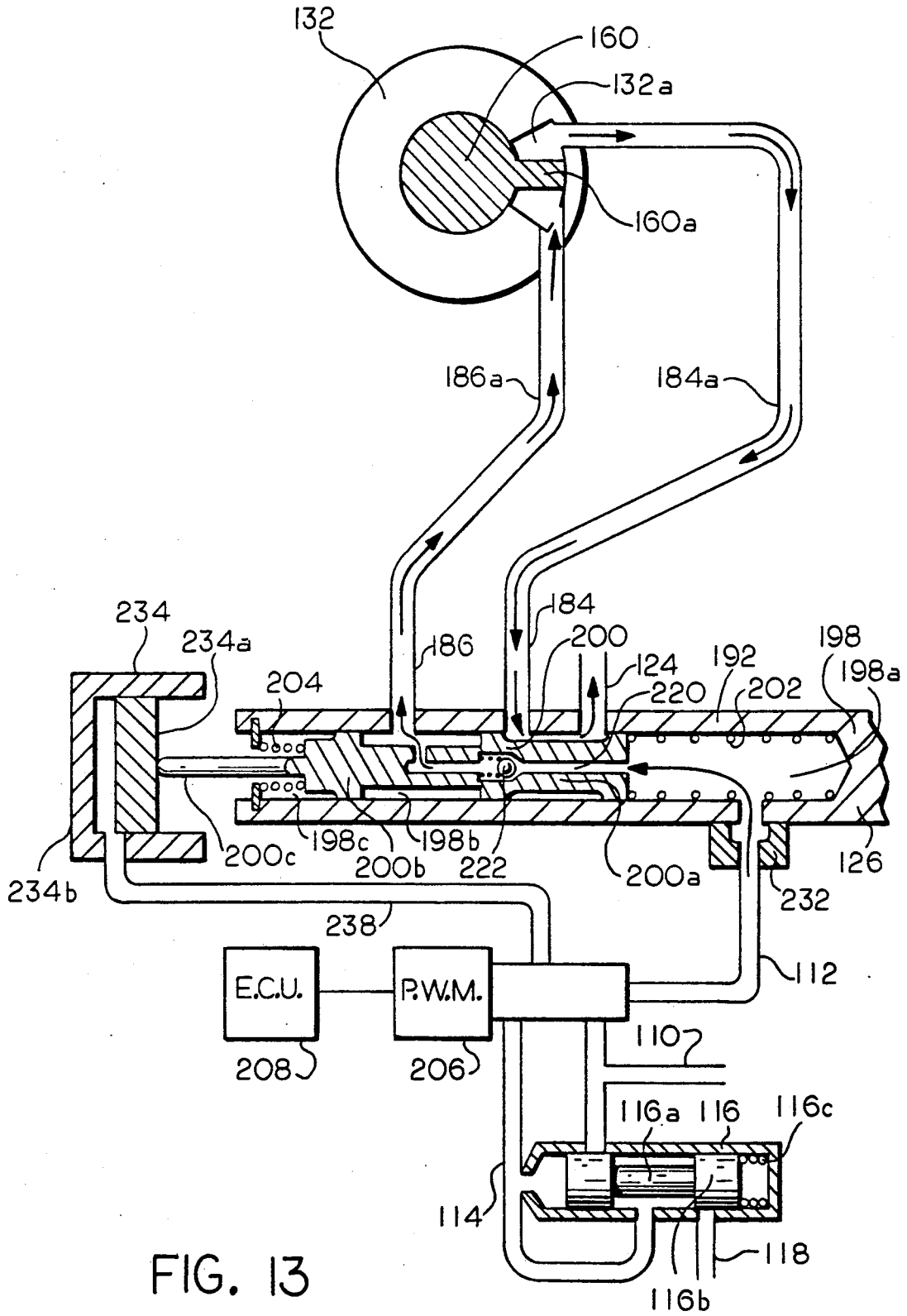
FIG. 13 is a schematic view of the hydraulic equipment of the variable camshaft timing arrangement according to an embodiment utilizing only one vane lobe to accomplish camshaft shift and illustrates a condition where the camshaft phase is shifting in the direction of the retarded position.

The spool valve 192 is made up of a cylindrical member 198 and a spool 200 which is slidable to and fro within the member 198. The spool 200 has cylindrical lands 200*a* and 200*b* on opposed ends thereof, and the lands 200*a* and 200*b*, which fit snugly within the member 198, can be positioned so that hydraulic fluid flows past lands 200*a* and 200*b* into passages lines 184 and 186, as is shown in FIGS. 8 and 11, or the land 200*b* will block flow of hydraulic fluid to the passage line 186, as is shown in FIGS. 9 and 12, or the land 200*a* will block the flow of hydraulic fluid to the passage line 184, as is shown in FIGS. 10 and 13.

FIG. 8 depicts the spool valve 192 in a position such that the VCT maintains its phase angle without shifting in either direction. Hydraulic fluid is routed to the passage lines 184, 186, which then distribute it to the branches 184*a*, 184*b*, 186*a* and 186*b*, whereupon it fills the recesses 132*a*, 132*b* on each side of the lobes 160*a*, 160*b*. With the pressure being the same on each side of the lobes 160*a*, 160*b*, no camshaft phase shift can occur.

FIG. 9 depicts the spool valve 192 such that the VCT shifts towards the advancing position. The spool valve 192 blocks pressurized hydraulic fluid flow in the passage line 186 while routing it to the passage line 186 while routing it to the passage line 186 which then distributes it to the branch lines 184*a*, 186*b*, whereupon it fills the recess 132*a* on the top of lobe 160*a*, and the recess 132*b* on the bottom of the lobe 160*b*. Hydraulic fluid present in the recesses 132*a*, 132*b* connected to the branch lines 186*a*, 186*b* is vented through those branch lines, into the passage line 186, past the land 200*b* of the spool valve 192, and back into the engine oil system via the space 198*c*. Each lobe 160*a*, 160*b* is subject to pressurized hydraulic fluid on one side and a vented recess on the other side producing a torque which advances the camshaft phase with respect to the crankshaft.

FIG. 10 depicts the spool valve 192 such that the VCT shifts towards the retarding position. The spool valve 192 blocks pressurized hydraulic fluid flow to the passage line 184 while routing it to the passage line 186 which then distributes it to the branch lines 186*a*, 186*b*, whereupon it fills the recess 132*a* on the bottom of the lobe 160*a*, and recess 132*b* on the top of the lobe 160*b*. Hydraulic fluid present in the recesses 132*a*, 132*b* connected to the branch lines 184*a*, 184*b* is vented through those branch lines, into the passage line 184, past the land 200*a* of the spool valve 124. Each lobe 160*a*, 160*b* is subject to pressurized hydraulic fluid on one side and a vented recess on the other side producing a torque which retards the camshaft phase with respect to the crankshaft.

Connection of the branch lines 184*a*, 184*b*, 186*a* and 186*b* to the recesses 132*a*, 132*b* in FIGS. 9 and 10 is such that when hydraulic fluid flows only into one or another of the passage lines 184 and 186, pressure on the lobes 160*a* and 160*b* produces torque in the same direction.

FIGS. 11–13 are schematics of an embodiment of the present invention in which the lobe 160*b*, the recess 132*b*, and the branch passage lines 184*b* and 186*b* of FIGS. 8–10 are eliminated. The passage lines 184*a* and 186*a* connect to the recess 132*a* on opposite sides of the lobe 160*a*. Operation of the VCT is the same as in FIGS. 8–10 except that there is less of a load placed on the engine oil pump but only half the torque is generated to phase shift the camshaft with respect to the crankshaft.

The position of the spool 200 within the member 198 is influenced by an opposed pair of springs 202, 204 which act on the ends of the lands 200*a*, 200*b*, respectively. Thus, the spring 202 resiliently urges the spool 200 to the left, in the orientation illustrated in FIG. 8, and the spring 204 resiliently urges the spool 200 to the right in such orientation. The position of the spool 200 within the member 198 is further influenced by a supply of pressurized hydraulic fluid within a portion 198*a* of the member 198, on the outside of the land 200*a*, which urges the spool 200 to the left. The portion 198*a* of the member 198 receives its pressurized fluid (engine oil) from the main oil gallery of the engine by way of conduits 110 and 112, and this oil is also used to lubricate a bearing 232 in which the camshaft 126 of the engine rotates.

The control of the position of the spool 200 within the member 198 is in response to hydraulic pressure within a control pressure cylinder 234 whose piston 234*a* bears against an extension 200*c* of the spool 200. The surface area of the piston 234*a* is greater than the surface area of the end of the spool 200 which is exposed to hydraulic pressure within the portion 198*a*, and is preferably twice as great. Thus, the hydraulic pressures which act in opposite directions on the spool 200 will be in balance when the pressure within the cylinder 234 is one-half that of the pressure within the portion 198*a*, assuming that the surface area of the piston 234*a* is twice that of the end of the land 200*a* of the spool. This facilitates the control of the position of the spool 200 in that, if the springs 202 and 204 are balanced, the spool 200 will remain in its null or centered position, as illustrated in FIG. 8, with less than full engine oil pressure in the cylinder 234, thus allowing the spool 200 to be moved in either direction by increasing or decreasing the pressure in the cylinder 234, as the case may be. Further, the operation of the springs 202, 204 will ensure the return of the spool 200 to its null or centered position when the hydraulic loads on the ends of the lands 200*a*, 200*b* comes into balance.

The pressure within the cylinder 234 is controlled by a solenoid 206, preferably of the pulse width modulated type (PWM), in response to a control signal from an electronic engine control unit (ECU) 208, shown schematically, which may be of conventional construction. With the spool 200 in its null position when the pressure in the cylinder 234 is equal to one-half the pressure in the portion 198*a*, as heretofore described, the on-off pulses of the solenoid 206 will be of equal duration; by increasing or decreasing the on duration relative to the off duration, the pressure in the cylinder 234 will be increased or decreased relative to such one-half level, thereby moving the spool 200 to the right or to the left, respectively. The solenoid 206 receives engine oil from the main engine oil gallery (not shown) through an inlet line 110 and selectively delivers engine oil from such source to the cylinder 234 through a supply line 238. As is shown in FIGS. 2 and 8–13, the cylinder 234 may be mounted at an exposed end of the camshaft 126 so that the piston 234*a* bears against an exposed free end 200*c* of the spool 200. In this case, as is shown in FIG. 2, the solenoid 206 is preferably mounted in a housing 234*b* which also houses the cylinder 234*a*.

Excess oil from the controller 206 is returned by way of an outlet line 114 to a low pressure regulator valve 116, which also receives supply oil from inlet line 110, and oil from the low pressure regulator valve 116 is returned to the engine oil sump by way of an outlet line 118. Flow through the outlet line 118 is blocked by a land 116*b* on a sliding spool 116*a* of the pressure regulator valve 116 unless the pressure in the line 114 is sufficient to overcome the biasing effect of a spring 116*c*. Thus, the low pressure regulator valve 116 serves to maintain a minimum oil pressure, for example, 15 p.s.i.g., in the portion 198*a* of the cylindrical member 198, notwithstanding an electrical or other failure of the controller 206.

By using imbalances between oppositely acting hydraulic loads from a common hydraulic source on the opposed ends of the spool 200 to move it in one direction or another, as opposed to using imbalances between a hydraulic load on one end and a mechanical load on an opposed end, the control system of FIGS. 8–13 is capable of operating independently of variations in the pressure of the hydraulic system. Thus, it is not necessary to vary the duty cycle of the solenoid 206 to maintain the spool 200 in any given position, for example, in its centered or null position, as the pressure of the hydraulic fluid changes during the operation of the system. In that regard, it is to be understood that the centered or null position of the spool 200 is in the position where no change in camshaft to crankshaft phase angle is occurring, and it is important to be able to rapidly and reliably position the spool 200 in its null position of proper operation of a VCT system.

Pressurized hydraulic fluid (engine oil) for VCT operation is provided by way of an internal passage 220 within the spool 200, from the passage 198*a* to an annular space 198*b* of the cylindrical member 198, from which it can flow into the passage lines 184 and 186. A check valve 222 is positioned within the passage 220 to block the flow of oil from the annular space 198*b* to the portion 198*a* of the cylindrical member 198.

The vane 160 is alternatingly urged in clockwise and counterclockwise directions by the torque produced when hydraulic fluid is pumped to recesses 132*a*, 132*b* as described above, and this torque tends to oscillate the vane 160, and, thus, the camshaft 126, relative to the sprocket 132. However, in the FIGS. 11 and 14, the position of the spool 200 within the cylindrical member 198 is such that oscillation is prevented by the hydraulic fluid within the recesses 132*a*, 132*b* of the sprocket 132 on opposite sides of the lobes 160*a*, 160*b*, respectively, of the vane 160. No hydraulic fluid can leave either of the recesses 132*a*, 132*b*, since both passage lines 184, 186 are connected to the hydraulic fluid source and flow to the vent 124 and the space 198*c* is blocked by the position of lands 200*a* and 200*b*, respectively. If, for example, it is desired to permit the camshaft 126 and vane 160 to move in a clockwise direction with respect to the sprocket 132, it is only necessary to increase the pressure within the cylinder 234 to a level greater than one-half that in the portion 198*a* of the cylindrical member. This will urge the spool 200 to the right thereby blocking hydraulic fluid flow from space 198*b* into passage line 186 while allowing venting through passage 186, and allowing hydraulic fluid flow from space 198*b* into passage line 184. In this condition of the apparatus, the clockwise torque produced by filling recesses 132*a*, 132*b* on the sides connected to branch lines 184*a*, 186*a* will pump fluid out of the portion of the recesses 132*a*, 132*b* connected to branch lines 184*b*, 186*b* and allow the lobes 160*a*, 160*b* of vane 160 to move into the portion of the recesses which have been emptied of hydraulic fluid.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A method of operating an internal combustion engine having a rotatable crankshaft and a rotatable camshaft, the camshaft being position variable relative to the crankshaft and being subject to torque reversals during the operation thereof, a vane with at least one lobe secured to the camshaft for rotation therewith, a housing having at least one recess receiving the at least one lobe of the vane and permitting oscillation of the at least one lobe within the at least one recess as the housing oscillates with respect to the camshaft, means for varying the position of the camshaft relative to the crankshaft, conduit means permitting unobstructed-flow of a hydraulic fluid to and from said at least one recess, and a weighted body fixedly attached to the camshaft for rotation therewith to counteract torque reversals in the camshaft, the method comprising:

actuating the means for varying the position of the camshaft relative to the crankshaft in reaction to torque reversals in the camshaft.

2. A method of operating an internal combustion engine having a rotatable crankshaft and a rotatable camshaft, the camshaft being position variable relative during the operation thereof, said camshaft having a weighted body fixedly attached thereto for rotation therewith to counteract torque reversals in said camshaft, the method comprising:

providing the camshaft with a vane at least one lobe, the vane being rotatable with the camshaft and being non-oscillatable with respect to the camshaft;

providing the camshaft with a housing having at least one recess, the housing being rotatable with the camshaft and being oscillatable with respect to the camshaft, the at least one recess of the housing receiving the at least one lobe of the vane and permitting oscillation of the at least one lobe within the at least one recess as the housing oscillates with respect to the camshaft;

providing conduit means permitting unobstructed flow of a hydraulic fluid to and from said at least one recess;

providing means for varying the position of the housing relative to the camshaft; and actuating the means for varying the position of the housing relative to the camshaft in reaction to torque reversals in the camshaft.

3. The method according to claim 2 wherein the means for varying the position of the housing relative to the camshaft comprises means for permitting the position of the housing to move in a first direction relative to the camshaft in reaction to a torque pulse in the camshaft in a first direction, means for preventing the position of the housing from moving relative to the camshaft in a second direction in reaction to a torque pulse in the camshaft in a second direction, and means for selectively reversing the first and second directions of the movement of the housing relative to the camshaft with respect to the first and second directions of torque pulses in the camshaft.

4. The method according to claim 3 wherein the at least one recess is capable of sustaining hydraulic pressure, wherein the at least one lobe divides the at least one recess into a first portion and a second portion, and wherein the varying of the position of the housing relative to the camshaft comprises:

transferring hydraulic fluid into one of the first portion and the second portion of the recess.

5. The method according to claim 4 wherein the varying of the position of the housing relative to the camshaft further comprises;

simultaneously transferring hydraulic fluid out of the other of the first portion and the second portion of the recess.

6. The method according to claim 4 wherein the hydraulic fluid is engine lubricating oil from a main oil gallery of the engine.

7. An internal combustion engine comprising:

a crankshaft, said crankshaft being rotatable about an axis;

a camshaft, said camshaft being rotatable about a second axis, said second axis being parallel to said axis, said camshaft being subject to torque reversals during the rotation thereof;

a weighted body fixedly attached to said camshaft for rotation therewith to counteract torque reversals in said camshaft;

a vane having at least one lobe, said vane being attached to said camshaft, being rotatable with said camshaft and being non-oscillatable with respect to said camshaft;

a housing which is rotatable with said camshaft and being oscillatable with respect to said camshaft, said housing having at least one recess, said at least one recess receiving said at least one lobe, said at least one lobe being oscillatable within said at least one recess;

conduit means permitting unobstructed flow of a hydraulic fluid to and from said at least one recess; and means reactive to torque reversals in the camshaft for varying the position of the housing relative to the camshaft.

8. An engine according to claim 7 wherein said means reactive to torque reversals comprises control means for permitting the housing to move in a first direction relative to the camshaft in reaction to a torque pulse in the camshaft in a first direction and for preventing the housing from moving in a second direction relative to the camshaft in reaction to a torque pulse in the camshaft in a second direction.

9. An engine according to claim 8 wherein said at least one lobe divides said at least one recess into a first portion and a second portion, wherein said control means comprises means for transferring hydraulic fluid into one of said first portion and said second portion of said at least one recess being capable of sustaining hydraulic pressure.

10. An engine according to claim 9 wherein said control means further comprises means for simultaneously transferring hydraulic fluid out of the other of said first portion and said second portion.

11. An engine according to claim 10 wherein each of said first portion and said second portion of said at least one recess is capable of sustaining hydraulic pressure, and wherein said control means is capable of being reversed to transfer hydraulic fluid out of said one of said first portion and said second portion and to transfer hydraulic fluid into said other of said first portion and said second portion, said engine further comprising:

an engine control unit responsive to at least one engine operating condition for selectively reversing the operation of said control means.

12. An engine according to claim 11 wherein said hydraulic fluid comprises engine lubricating oil, and further comprising:

conduit means for transferring engine lubricating oil from a portion of said engine to said control means.

13. An internal combustion engine comprising:

a crankshaft, said crankshaft being rotatable about an axis;

a camshaft, said camshaft being rotatable about a second axis, said second axis being parallel to said axis, said camshaft being subject to torque reversals during the rotation thereof;

a weighted body fixedly attached to said camshaft for rotation therewith to counteract torque reversals in said camshaft;

a vane having first and second circumferentially spaced apart lobes, said vane being attached to said camshaft, being rotatable with said camshaft and being non-oscillatable with respect to said camshaft;

a housing which is rotatable with said camshaft and which is oscillatable with respect to said camshaft and having first and second circumferentially spaced apart recesses, each of said first and second recesses receiving one of said first and second lobes and permitting oscillating movement of said one of said first and second lobes therein;

conduit means permitting unobstructed flow of a hydraulic fluid to and from said first and second recesses; and means reactive to torque reversals in the camshaft for varying the position of the housing relative to the camshaft.

14. An engine according to claim 13 wherein said means reactive to torque reversals comprises control means for permitting the housing to move in a first direction relative to the camshaft in reaction to a torque pulse in the camshaft in a first direction and for preventing the housing from moving in a second direction relative to the camshaft in reaction to a torque pulse in the camshaft in a second direction.

15. An engine according to claim 14 wherein each of said first and second lobes respectively divides each of said first and second recesses into a first portion and a second portion, wherein said control means comprises means for transferring hydraulic fluid into one of said first portion and said second portion of each of said first and second recesses, each of said one of said first portion and said second portion of said each of said first and second recesses being capable of sustaining hydraulic pressure.

16. An engine according to claim 15 wherein said control means comprises means for simultaneously transferring hydraulic fluid out of the other of said first portion and second portion of said each of said first and second recesses.

17. An engine according to claim 16 wherein each of said first portion and said second portion of each of said first and second recesses is capable of sustaining hydraulic pressure, and wherein said control means is capable of being reversed to transfer hydraulic fluid out of said one of said first portion and said second portion of said each of said first and second recesses and to transfer hydraulic fluid into said other of said first portion and said second portion of said each of said first and second recesses, said engine further comprising:

an engine control unit response to at least one engine operating condition for selectively reversing the operation of said control means.

18. An engine according to claim 17 wherein said hydraulic fluid comprises engine lubricating oil, and further comprising:

conduit means for transferring engine lubricating oil from a portion of said engine to said control means.

19. An engine according to claim 18 wherein said control means includes a spool valve, said spool valve having a body and a spool member which is adapted to move longitudinally within said body, said spool member having an outermost end, and force means for selectively imposing a force on said spool member to move said spool member away from said force means.

20. An internal combustion engine comprising:

a crankshaft, said crankshaft being rotatable about an axis;

a camshaft, said camshaft being rotatable about a second axis, said second axis being parallel to said axis, said camshaft being subject to torque reversals during the rotation thereof;

a weighted body fixedly attached to said camshaft for rotation therewith to counteract torque reversals in said camshaft;

a vane having only one lobe, said vane being attached to said camshaft, being rotatable with said camshaft and being non-oscillatable with respect to said camshaft;

a housing which is rotatable with said camshaft and being oscillatable with respect to said camshaft, said housing having only one recess, said only one recess receiving said at only one lobe, said only one lobe being oscillatable within said only one recess;

conduit means permitting unobstructed flow of a hydraulic fluid to and from said only the recess; and means reactive to torque reversals in the camshaft for varying the position of the housing relative to the camshaft.

21. An engine according to claim 20 wherein said means reactive to torque reversals comprises control means for permitting the housing to move in a first direction relative to the camshaft in reaction to a torque pulse in the camshaft in a first direction and for preventing the housing from moving in a second direction relative to the camshaft in reaction to a torque pulse in the camshaft in a second direction.

22. An engine according to claim 21 wherein said only one lobe divides said only one recess into a first portion and a second portion, wherein said control means comprises means for transferring hydraulic fluid into one of said first portion and said second portion of said only one recess, said only one recess being capable of sustaining hydraulic pressure.

23. An engine according to claim 22 wherein said control means further comprises means for simultaneously transferring hydraulic fluid out of the other of said first portion and said second portion.

24. An engine according to claim 23 wherein each of said first portion and said second portion of said only one recess is capable of sustaining hydraulic pressure, and wherein said control means is capable of being reversed to transfer hydraulic fluid out of said one of said first portion and said second portion and to transfer hydraulic fluid into said other of said first portion and said second portion, said engine further comprising:

an engine control unit responsive to at least one engine operating condition for selectively reversing the operation of said control means.

25. An engine according to claim 24 wherein said hydraulic fluid comprises engine lubricating oil, and further comprising:

conduit means for transferring engine lubricating oil from a portion of said engine to said control means.

* * * * *

UNITED STATES PATENT AND TRADEMARK OFFICE

CERTIFICATE OF CORRECTION

PATENT NO. : 5,205,249
DATED : April 27, 1993
INVENTOR(S) : George L. Markley, et. al.

It is certified that error appears in the above-indentified patent and that said Letters Patent is hereby corrected as shown below:

Column 5, line 30, "in" should be --to--.
Column 5, line 31, "186" should be --184--.
Column 5, line 32, "while routing it to the passage line 186" should be deleted--.
Column 5, line 54, after "valve" insert --192, and back into the engine oil system via the vent--.
Column 7, line 31, "of" should be --for--.
Column 8, Claim 1, line 31, "camshaft" should be --housing--. "crankshaft" should be --camshaft--.
Column 8, Claim 2, line 35, after "relative" insert --to the crankshaft and being subject to torque reversals--.
Column 8, Claim 2, line 40, after "vane" insert --having--.

Signed and Sealed this

Eleventh Day of January, 1994

Bruce Lehman

*Attest:*

BRUCE LEHMAN

*Attesting Officer*

*Commissioner of Patents and Trademarks*